US006609916B2

(12) United States Patent
Okabe

(10) Patent No.: US 6,609,916 B2
(45) Date of Patent: Aug. 26, 2003

(54) BAND-LIKE CONDUCTOR CONNECTING CONNECTOR

(75) Inventor: Toshiaki Okabe, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 60 days.

(21) Appl. No.: 09/924,477

(22) Filed: Aug. 9, 2001

(65) Prior Publication Data

US 2002/0020544 A1 Feb. 21, 2002

(51) Int. Cl.[7] ..... H01R 9/09
(52) U.S. Cl. ..... 439/77
(58) Field of Search ..... 439/77, 557, 247, 439/248

(56) References Cited

U.S. PATENT DOCUMENTS 3,088,089 A * 4/1963 Gregoire ..... 439/272
5,591,040 A * 1/1997 Dohan et al. ..... 439/248
5,605,150 A * 2/1997 Radons et al. ..... 600/300
5,803,758 A * 9/1998 Kameyama ..... 439/248

* cited by examiner

*Primary Examiner*—Neil Abrams
*Assistant Examiner*—Phoung K T Dinh
(74) *Attorney, Agent, or Firm*—Finnegan, Henderson, Farabow, Garrett, & Dunner, L.L.P.

(57) ABSTRACT

A band-like conductor connecting connector comprises a second connector 6 which is inserted into a first connector 2 to release a temporarily locked state between the first connector 2 and the holder 1, and which pushes the band-like conductor together with the first connector 2 toward a bottom of the holder 1, wherein in a process during which the second connector 6 pushes the first connector 2 toward the bottom of the holder 1, a plurality of terminal metal fittings 19 provided on a tip end of the second connector 6 push the band-like conductor 5 into the bottom of the holder 1 while scrubbing the exposed wire conductor patterns.

14 Claims, 14 Drawing Sheets

BAND-LIKE CONDUCTOR CONNECTING CONNECTOR

BACKGROUND OF THE INVENTION

1. Field of the Invention

The present invention relates to a band-like connector for connecting a connector and a band-like conductor such as an FFC (flexible flat cable) or an FPC (flexible printed circuit).

2. Description of the Related Art

For example, there is a known structure in which a conductor pattern is formed on a surface of a base film using a technique such as etching method or plating method, this conductor pattern is covered and coated with a cover lay film in an insulative manner, thereby forming a flexible printed circuit (hereinafter, referred to as FPC,), and this flexible printed circuit and a connector are connected.

In a connector used for such a structure, metal fittings having conductor-contacting portions are accommodated in respective terminal accommodation chambers, and the conductor-contacting portions face outward from the terminal accommodation chambers.

On the other hand, the FPC is fixed on a surface of a meter case in such a manner that the FPC is provided along an inner wall surface of a connector fitting recess formed in the meter case. The cover lay film of the FPC provided along the inner wall surface of the connector fitting recess is removed for bringing the FPC and the conductor-contacting portion of the terminal metal fitting into electrical contact with each other. That is, the conductor pattern is exposed.

In such a structure, if the connector is mounted to the meter case, the conductor-contacting portion exposed from the terminal accommodation chamber comes into contact with the conductor pattern of the FPC, and the terminal fitting and the FPC are brought into conduction, In the above structure, however, since a region where the contact therebetween can be ensure with respect to positional deviation in a fitting direction of the connector and the meter case is narrow, if precision in size of a connector mounting portion is not excellent, there is an adverse possibility that the conductor patterns of the FPC and the corresponding conductor-contacting portions are not brought into contact with each other. Further, when there is an insulative object such as an oxide film on the contact portion between the conductor pattern and the conductor-contacting portion, there is a problem that the connecting reliability therebetween is deteriorated.

SUMMARY OF THE INVENTION

The present invention has been proposed to solve the above problems, and it is an object of the invention to provide a band-like conductor connecting connector having high connecting reliability between a terminal metal fitting and a conductor pattern.

The present invention provides a band-like conductor connecting connector comprising holder, a first connector which is accommodated and temporarily locked in the holder, a band-like conductor disposed substantially straightly from one side surface to the other side surface of the holder through openings and respectively formed in the holder and the first connector such as to pass therethrough, the band-like conductor sandwiching a plurality of wire conductor patterns with an insulative film and a portion of the band-like conductor at least disposed in the holder exposing the wire conductor patterns, and a second connector which is inserted into the first connector to release a temporarily locked state between the first connector and the holder, and which pushes the band-like conductor together with the first connector toward a bottom of the holder, wherein in a process during which the second connector pushes the first connector toward the bottom of the holder, a plurality of terminal metal fittings provided on a tip end of the second connector push the band-like conductor into the bottom of the holder while scrubbing the exposed wire conductor patterns.

With this band-like conductor connecting connector, in the process during which the second connector pushes the first connector toward the bottom of the holder, the plurality of terminal metal fittings provided on a tip end of the second connector scrubs the exposed wire conductor patterns. Therefore, the insulative matter such as oxide film adhered on the surface of the wire conductor pattern is removed. With this removal of the insulative matter, the connecting reliability between the wire conductor pattern and the terminal metal fitting is enhanced.

Further, in the present invention, the band-like conductor is sandwiched between the bottom of the first connector and the second connector. With this feature, the band-like conductor is sandwiched between the bottom of the first connector and the second connector. Therefore, the terminal metal fitting provided on the tip end of the second connector and the wire conductor pattern are reliably brought into contact with each other.

Further, the first connector is provided at its bottom with a receiving stage of the band-like conductor. This receiving stage serves as a pedestal of the wire conductor pattern, and the terminal metal fitting and the wire conductor pattern can reliably be brought into contact with each other under pressure.

BRIEF DESCRIPTION OF THE DRAWINGS

FIGS. 1A, 1B and 1C show a holder in a band-like conductor connecting connector of an embodiment, wherein FIG. 1A is a plan view, FIG. 1B is a front view and FIG. 1C is a side view;

FIGS. 2A and 2B show the holder in the band-like conductor connecting connector of the embodiment, wherein FIG. 2A is a sectional view taken along a line IIA—IIA in FIG. 1A, and FIG. 2B is a sectional view taken along a line IIB—IIB in FIG. 1A;

FIGS. 3A, 3B and 3C show a first connector in the band-like conductor connecting connector of the embodiment wherein FIG. 3A is a plan view, FIG. 3B is a front view and FIG. 3C is a side view;

FIGS. 6A and 6B show the second connector in the band-like conductor connecting connector of the embodiment, wherein FIG. 6A is a rear view showing a state in which the electric wire cover is removed, and FIG. 6B is a bottom view;

FIGS. 7A, 7B and 7C show a first connector in the band-like conductor connecting connector of the embodiment, wherein FIG. 7A is a front view, FIG. 7B is a plan view and FIG. 7C is a side view;

DETAILED DESCRIPTION OF THE PREFERRED EMBODIMENTS

Figure 1A:
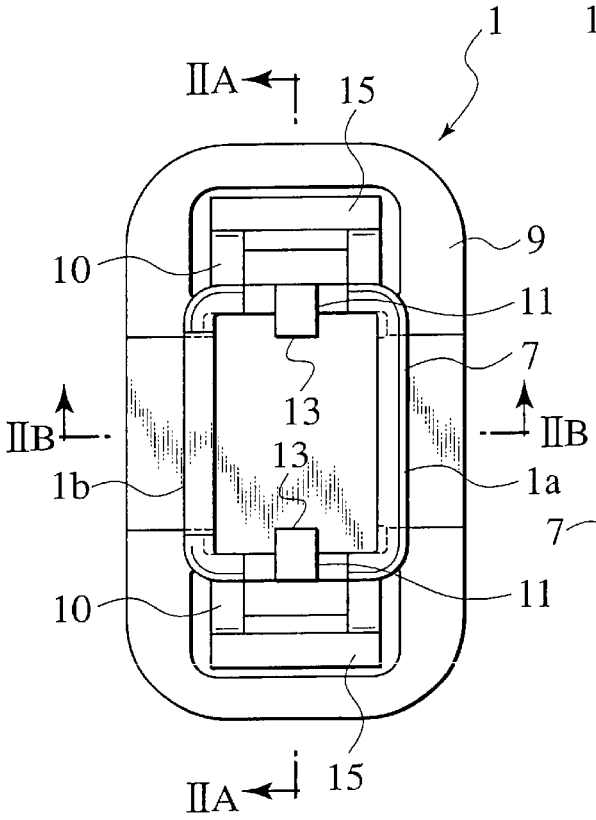
Figure 1C:
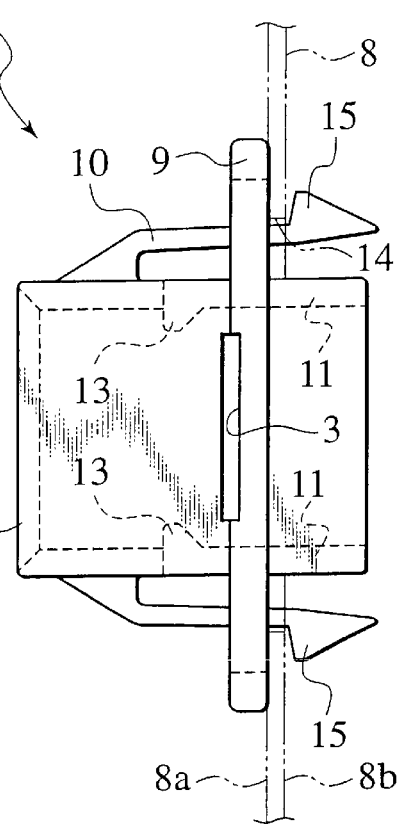
Figure 1B:
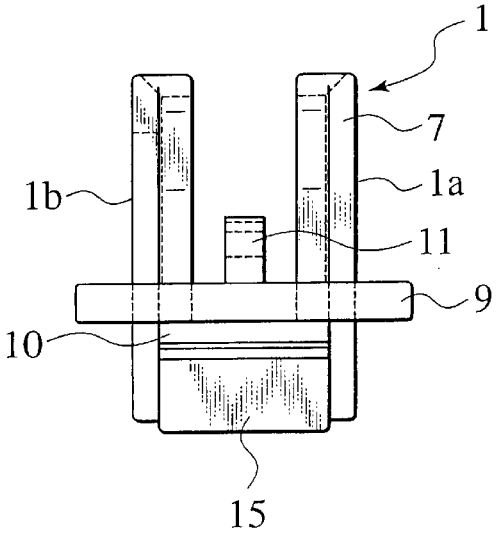
Figure 2A:
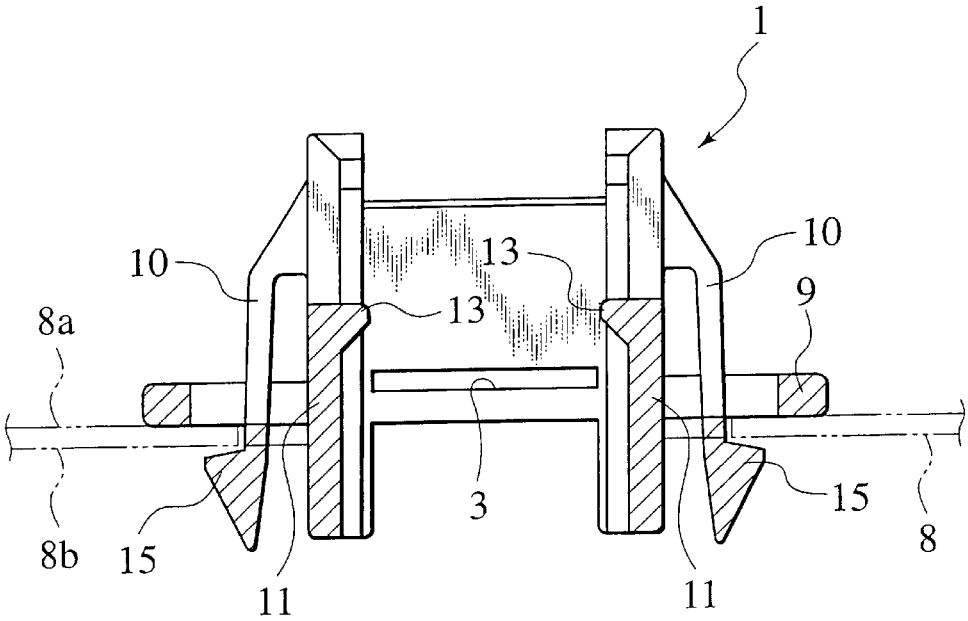
Figure 2B:
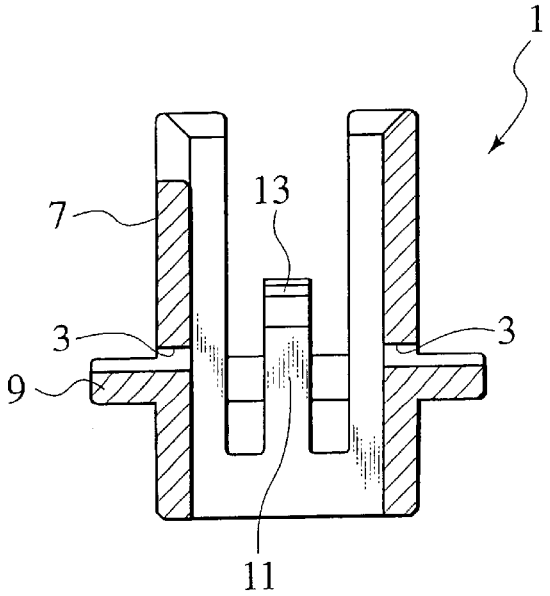

A concrete embodiment to which the present invention is applied will be explained in detail with reference to the drawings below.

The present embodiment is an example of a band-like conductor connecting connector for connecting a connector on the side of a sun visor for an automobile provided with a lamp and the like and another connector provided in a roof trim to each other utilizing a terminal metal fitting and a conductor pattern,

Structure of Band-Like Conductor Connecting Connector

As shown in FIGS. 1A to 7C, a band-like conductor connecting connector of this embodiment comprises a holder 1, a first connector 2 which is accommodated and temporarily locked in the holder 1, a band-like conductor 5 disposed substantially straightly from one side surface 1*a* to the other side surface 1*b* of the holder 1 through opening portion 3 and 4 respectively formed in the holder 1 and the first connector 2 such as to pass therethrough, the band-like conductor sandwiching a plurality of wire conductor patterns with an insulative film and a portion of the band-like conductor 5 at least disposed in the holder 1 exposing the wire conductor patterns, and a second connector 6 which is inserted into the first connector 2 to release a temporarily locked state between the first connector 2 and the holder 1, and which pushes the band-like conductor 5 together with the first connector 2 toward a bottom of the holder 1.

Structure of Holder

As shown in FIGS. 1A to 2B, the holder 1 comprises a housing body 7 in which the first connector 2 is accommodated and held, temporarily locking arms 11 for temporarily locking the first connector 2, flange portion 9 and hooking arm portion 10 for mounting and fixing the housing body 7 to a panel 8.

The housing body 7 is formed into a cylindrical body having substantially rectangular plane and having a size enough to accommodate the first connector 2 therein. The housing body 7 is formed with the opening portion 3 through for allowing the band-like conductor 5 such as an FPC (hereinafter, referred to as flexible flat cable) or the FPC to pass through the housing body 7. This opening portion 3 has enough size to allow the band-like conductor 5 to pass therethrough, and formed in portions of opposite side walls which are adjacent to side walls on which the hooking arm portion 10 are formed and opposed to each other and portions of the flange portion 9.

The temporarily locking arms 11 serve to hold the first connector 2 in its temporarily locked state, and are formed on opposed side walls of the housing body 7 in its longitudinal direction. A tip end of each of the temporarily locking arm 11 is formed with a hooking pawl 13 for supporting a temporarily displacing piece 12 formed on the first connector 2 and temporarily locking the first connector 2 in the housing body 7. The hooking pawl 13 is formed such as to project into the housing body 7, and supports a temporarily displacing piece 12. The temporarily locking arms 11 can displace in a direction away from each other an such a manner that the hooking pawls 13 act as free ends.

The flange portion 9 is formed as a flange portion having a substantially rectangular plane, and is formed slightly on the side of the panel 8 from substantially a central portion of the housing body 7. The flange portion 9 is disposed on the panel 8 such as to cover an opening peripheral edge of a holder mounting hole 14 formed in the panel 8. The hooking arm portion 10 is formed on a side wall of the housing body 7 on which the temporarily locking arm 11 is formed. A portion of the hooking arm portion 10 closer to an insertion side of the first connector 2 is a base end, and a portion of the hooking arm portion 10 closer to a tip end of the first connector 2 is a free end. The hooking arm portion 10 is brought into a so-called cantilever state such that the arm 10 extends toward the panel from the base end. The hooking arm portion 10 is formed at its tip end with a grasping pawl 15 which abuts against a back surface 8*b* on the opposite side from a holder mounting surface 8*a* of the panel 8 and which grasps the panel 8 together with the flange portion 9. The panel 8 is grasped between the grasping pawl 15 and the flange portion 9, thereby sandwiching and fixing the holder 1 by the panel 8.

Structure of First Connector

Figure 3A:
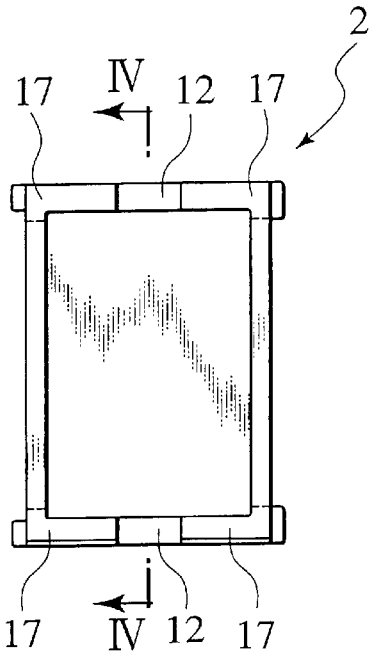
Figure 3C:
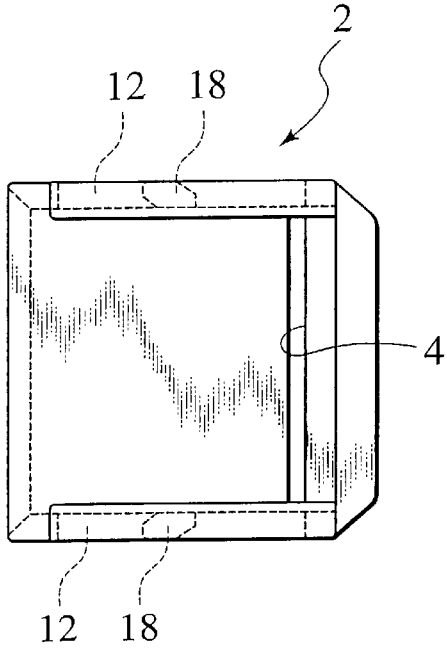
Figure 3B:
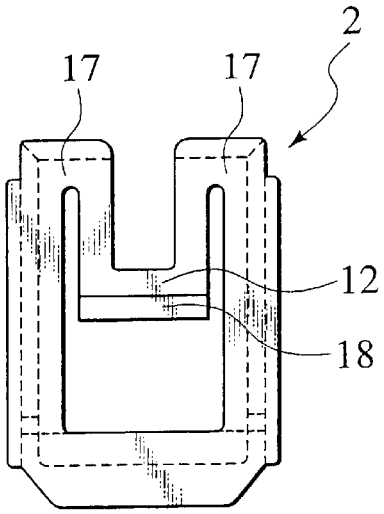
Figure 4:
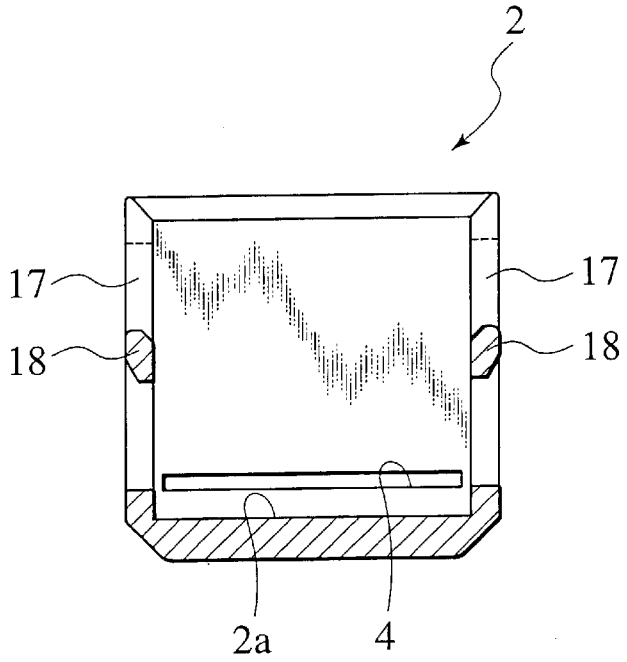
FIG. 4 shows the first connector in the band-like conductor connecting connector of the embodiment, and is a sectional view taken along a line IV—IV in FIG. 3A.

As shown in FIGS. 3A to 4, the first connector 2 has an inner space in which the second connector 6 can be fitted, and is formed into a box having such a size the first connector 2 can be accommodated in the holder 1. The first connector 2 is formed with temporarily displacing pieces 12 for temporarily locking the first connector 2 to the holder 1. The temporarily displacing pieces 12 are formed on opposite edges of the first connector 2 in its longitudinal direction as substantially U-shaped arms through connecting portions 17. Each of the temporarily displacing pieces 12 functions as a support portion 18 for abutting against the hooking pawl 13 of the temporarily locking arm 11, and displaces outward using the support portion 18 as a free end.

The first connector 2 is formed with the opening portion 4 for allowing the band-like conductor 5 to pass through the first connector 2. The opening portion 4 has enough size to allow the band-like conductor 5 to pass therethrough, and formed in opposite side walls adjacent to a side wall on which the temporarily displacing pieces 12 is formed. The opening portion 4 is opposed to the opening portion 3 formed in the holder 1 when the first connector 2 is temporarily locked to the holder 1.

Structure of Second Connector

Figure 9:
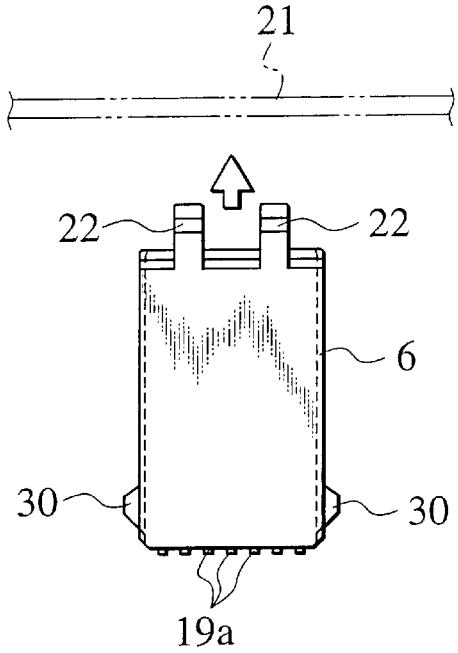
FIG. 9 is a view showing action of a state in which the second connector is mounted to a roof trim.

As shown in FIGS. 5 to 7C, the second connector 6 comprises a connector body 20 for holding a terminal metal fitting 19 and an electric wire (not shown) connected to the terminal metal fitting 19, and connector mounting portions 22 for fixing the connector body 20 to a roof trim 21 (see FIG. 9).

Figure 5:
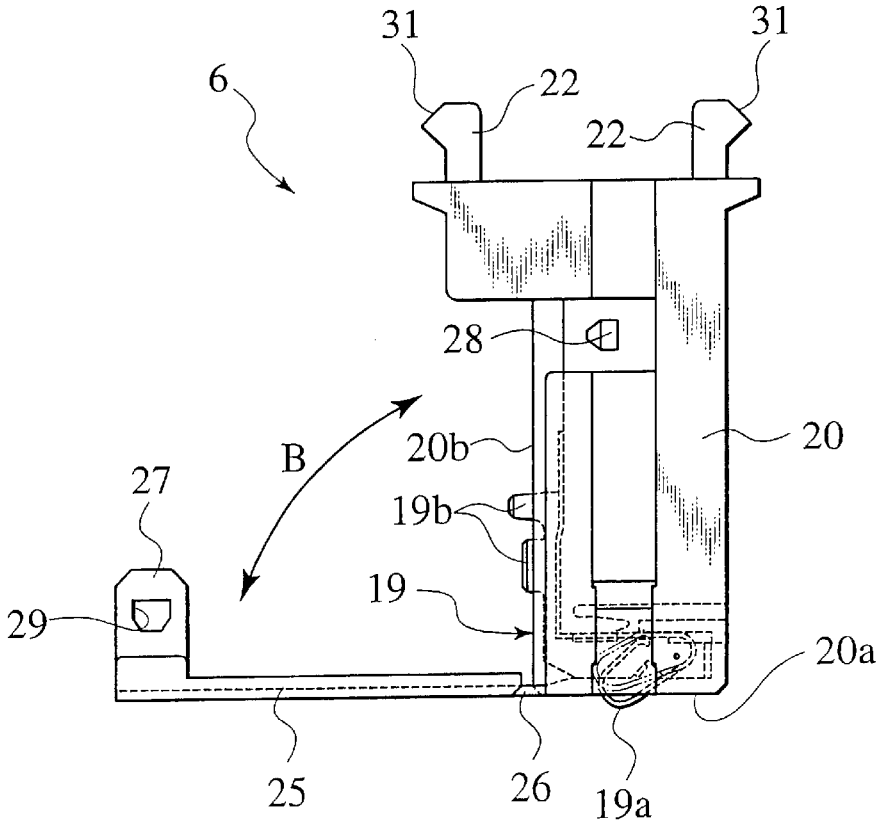
FIG. 5 is a side view shows a second connector in the band-like conductor connecting connector of the embodiment, and is a side view showing a state in which an electric wire cover is opened.
Figure 6A:
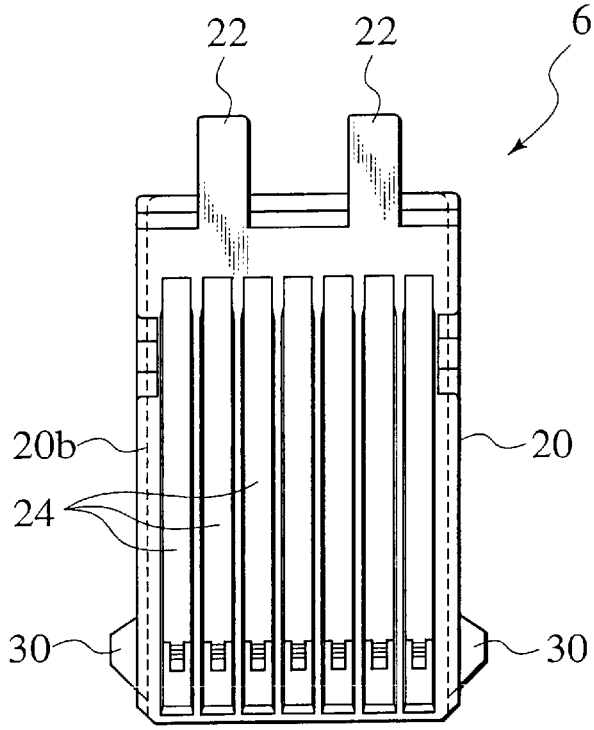
Figure 6B:
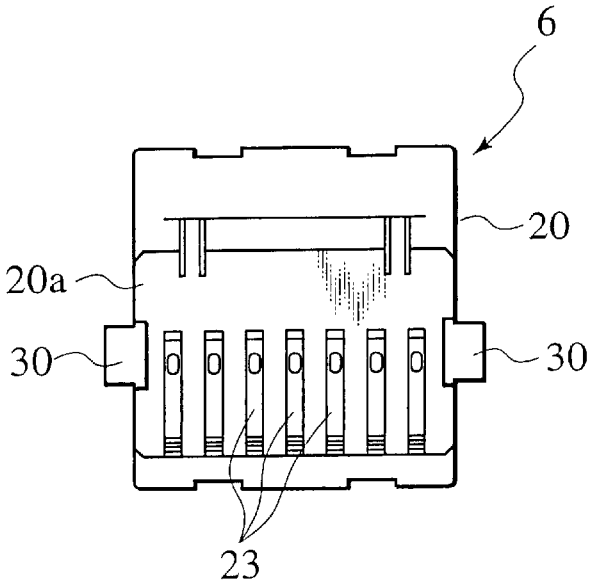

As shown in FIG. 5, the terminal metal fitting 19 comprises a contact portion 19*a* which comes into contact of a wire conductor pattern of the band-like conductor 5, and electric wire holding portions 19*b*. The terminal metal fitting 19 is formed into substantially L-shape. A portion of the contact portion 19*a* protecting from an end surface 20*a* in a direction in which the contact portion 19*a* is fitted to the first connector is curled and has resiliency, and the contact portion 19*a* is brought into contact with the wire conductor pattern under pressure with this resilient force. The contact portion 19*a* is disposed in a contact portion accommodating groove 23 (see FIG. 6B) formed in the end surface 20*a* of the connector body 20.

Figure 7A:
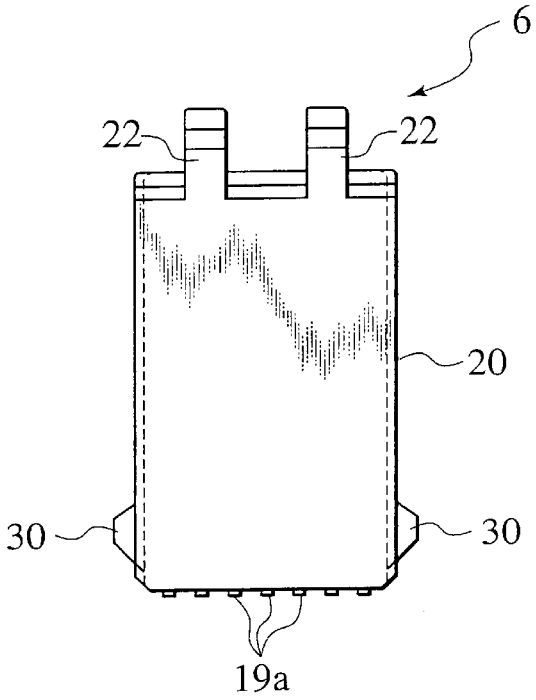
Figure 7B:
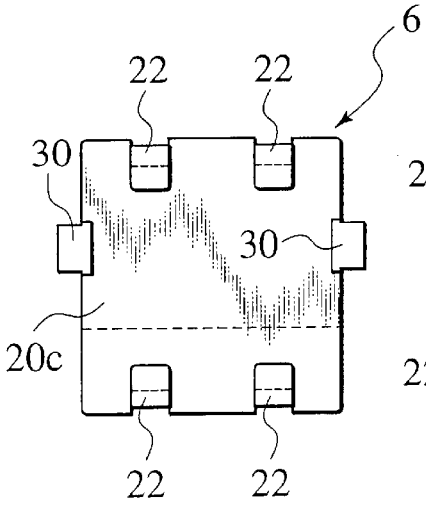
Figure 7C:
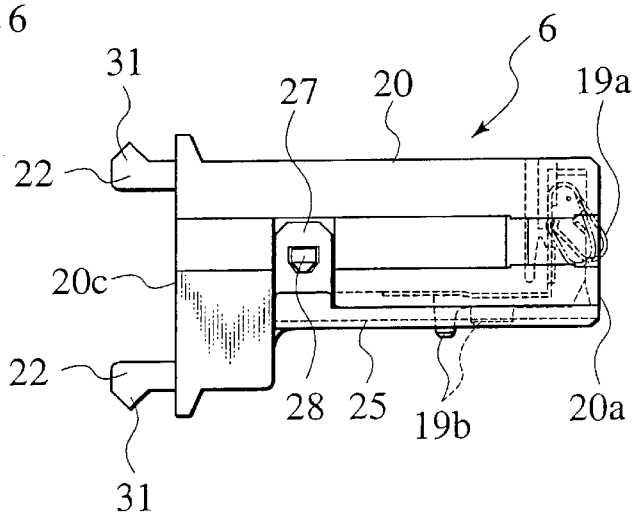

On the other hand, the electric wire holding portions 19*b* are disposed in electric wire holding grooves 24 (see FIG. 6A) formed in one side surface 20*b* of the connector body 20. As shown in FIG. 7C, the electric wire holding portions 19*b* and electric wires disposed in the electric wire holding grooves 24 are covered with an electric wire cover 25. As shown in FIG. 5, the electric wire cover 25 is rotatably provided on a tip end of the connector body 20 through a hinge portion 26 in a direction of an arrow B in FIG. 5. The electric wire cover 25 is formed with a lock portion 27 for locking the electric wire cover 25 to the connector body 20. The lock portion 27 is formed with a lock hole 29 into which a projection 28 formed on the connector body 20 is fitted. By fitting the projection 28 into the lock hole 29, the electric wire cover 25 is locked to the connector body 20.

Moreover, the connector body 20 is formed with releasing projections 30 for releasing the temporarily locked state of the first connector 2 which was locked to the holder 1. The releasing projections 30 are projecting from opposite side surfaces of the connector body 20 on their sides to which the first connector is fitted, the releasing projections 30 abut against the temporarily displacing pieces 12 and the hooking pawls 13.

The connector mounting portions 22 are projecting from surfaces on the opposite side 20*a* to which the first connector is fitted, pawl portion 31 formed on tip ends of the connector mounting portions 22 are locked to a back surface of the roof trim 21, thereby fixing the second connector 6 to the roof trim 21.

Coupling Action of the Connector

Next, action for coupling the second connector 6 to the first connector 2 which was temporarily locked to the holder 1 will be explained with reference to FIGS. 8 to 17.

Figure 8:
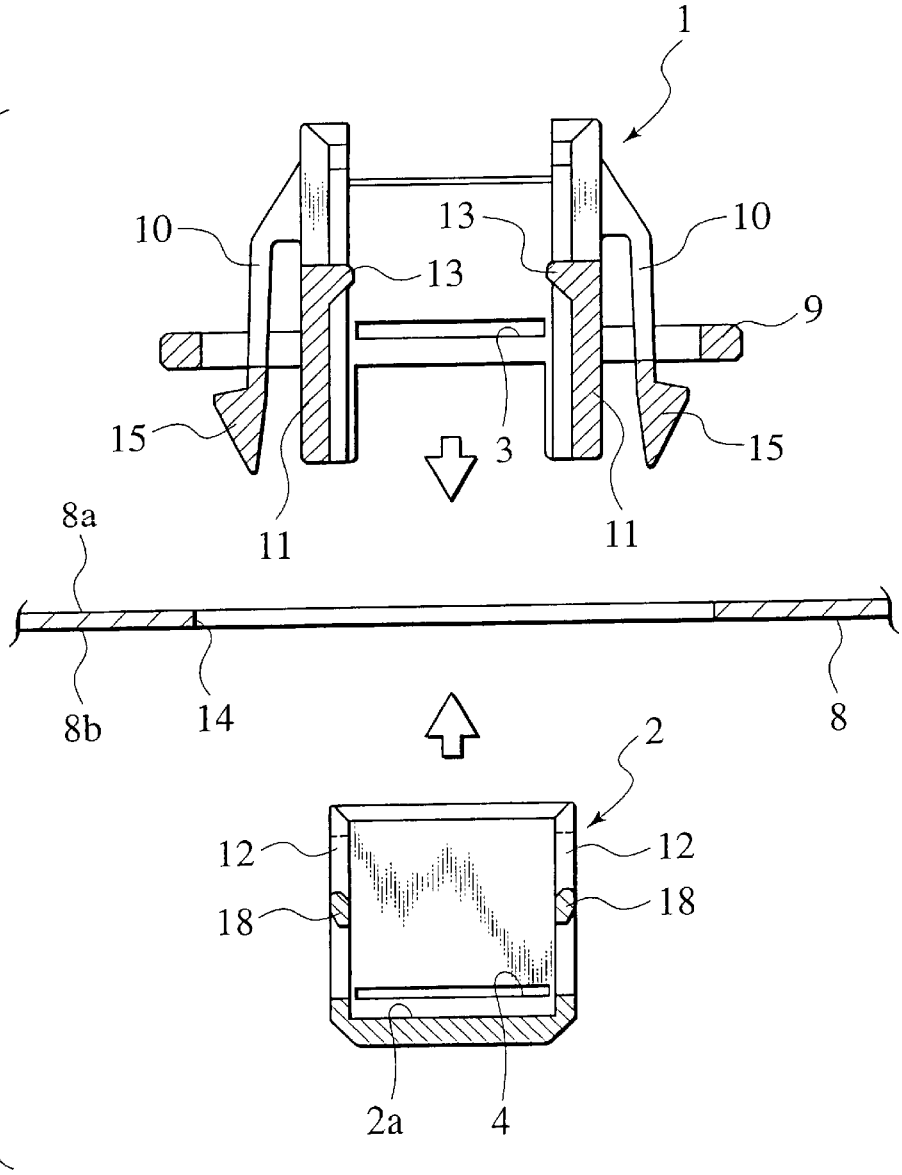
FIG. 8 is a view showing action of a state in which the first connector is mounted to the holder and the holder is fixed to a panel.

First, as shown in FIG. 8, the holder 1 is mounted to the panel 8. When the holder 1 is mounted to the panel 8, the housing body and the hooking arm portion 10 are allowed to face the holder mounting hole 14 formed on the panel 8, the grasping pawls 15 formed on the hooking arm portion 10 are locked to the back surface 8*b* of the panel 8. Then, if the opening peripheral edge of the holder mounting hole 14 is grasped by the flange portion 9 and the grasping pawls 15, the holder 1 is mounted to the panel 8.

Figure 11:
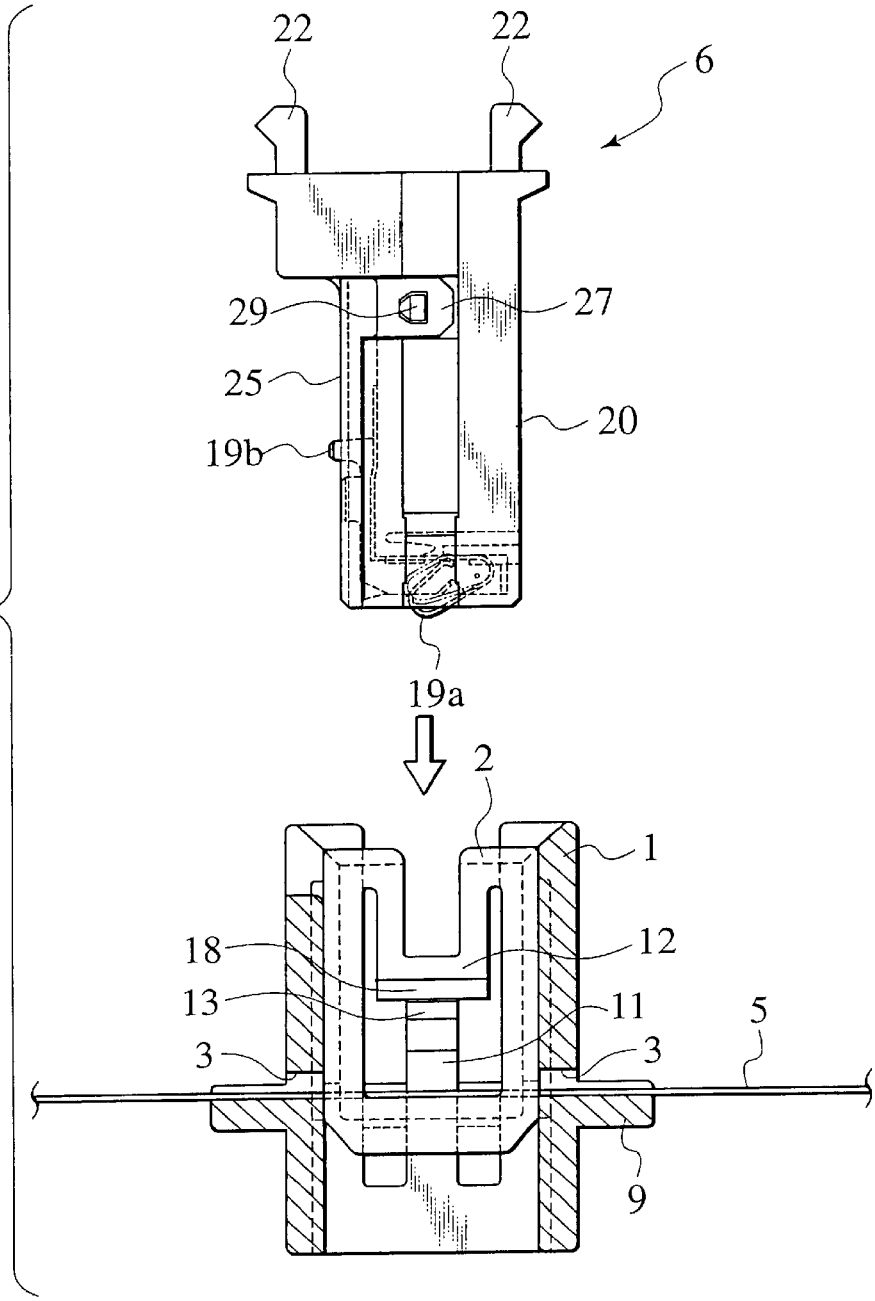
FIG. 11 is a view showing action of a state before the band-like conductor is disposed on the first connector and the holder, and the first connector and the second connector are fitted to each other.

Next, the first connector 2 is temporarily locked to the holder 1 mounted to the panel 8. That is, the first connector 2 is inserted into the holder 1 through the holder mounting hole 14 from the back surface 8*b* of the panel 8. Then, the support portions 18 of the temporarily displacing pieces 12 formed on the first connector 2 are placed on the hooking pawls 13 of the temporarily locking arms 11 formed on the holder 1. With this operation, the opening portion 3 formed in the holder 1 and the opening portion 4 formed in the first connector 2 are opposed to each other. Here, as shown in FIG. 11, the band-like conductor 5 is allowed to pass through the holder 1 and the first connector 2 from the one surface la of the holder 1 to the other side surface 1*b*. As a result, the band-like conductor 5 is disposed on a substantially straight line.

A receiving stage 32 such as an iron plate which receives the band-like conductor 5 is disposed on a bottom 2*a* in the opening of the first connector 2.

Figure 10:
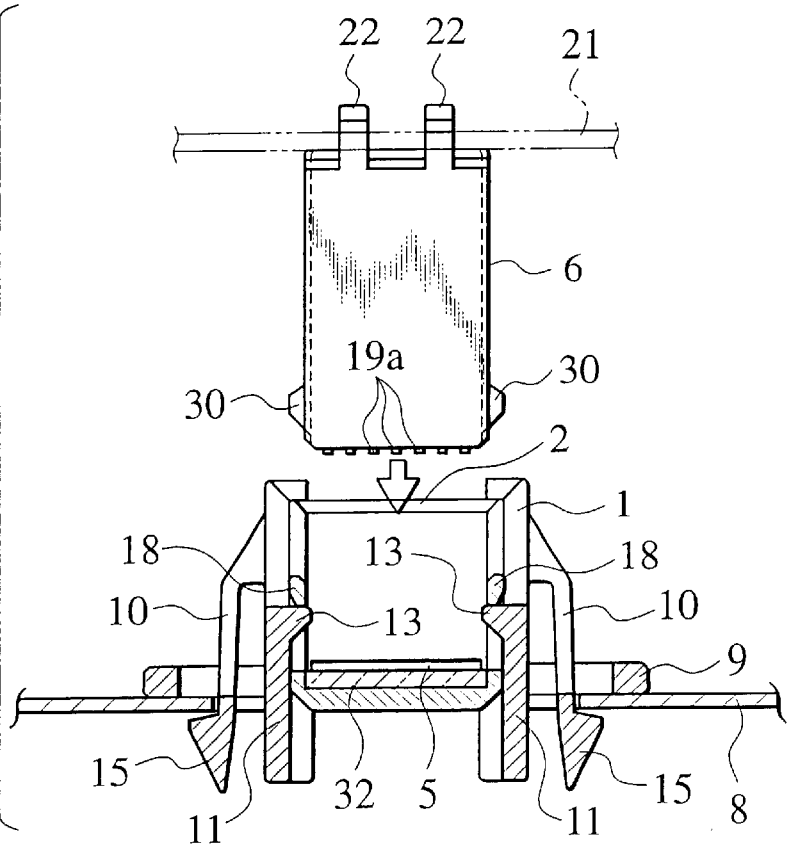
FIG. 10 is a view showing action of a state before the first connector and the second connector are fitted to each other.
Figure 12:
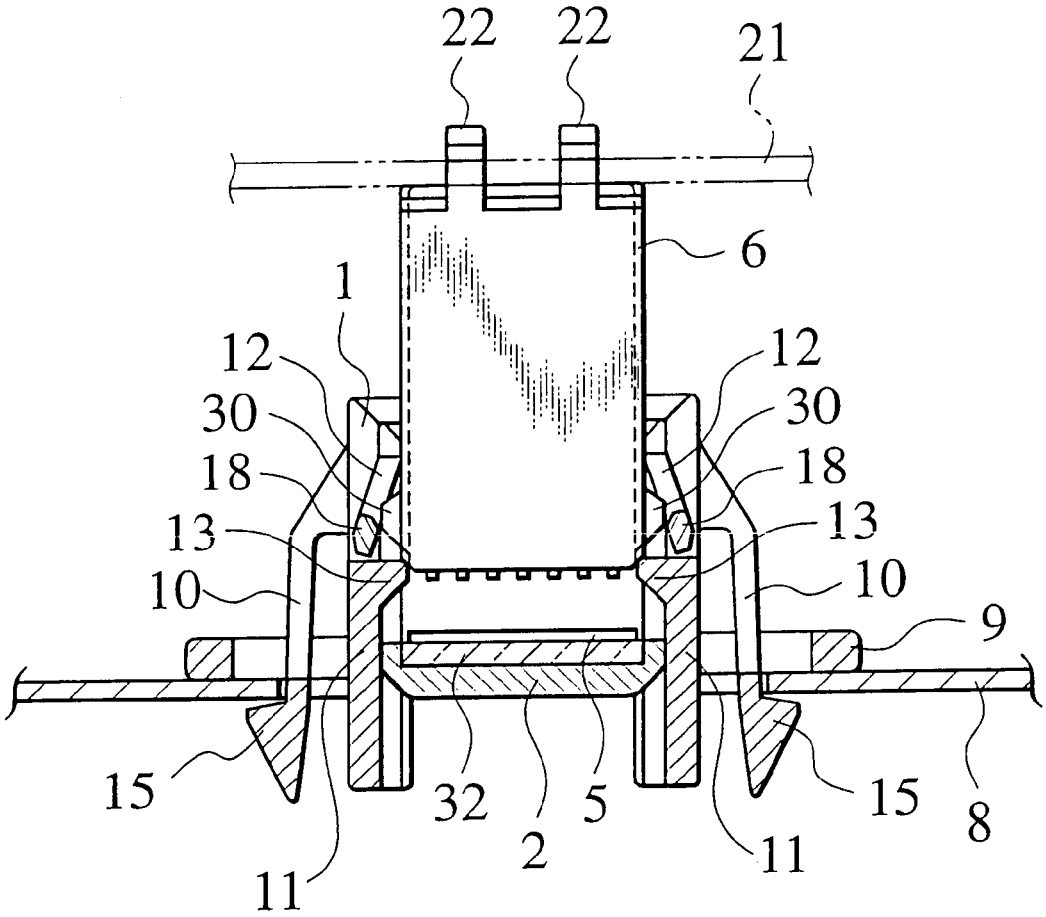
FIG. 12 is a view showing action of a state in which the second connector start fitting to the first connector.

Next, as shown in FIG. 9, the second connector 6 is mounted to the roof trim 21. To mount the second connector 6 to the roof trim 21, the connector mounting portion 22 is locked to the roof trim 21. Then, as shown in FIG. 10, the first connector 2 mounted to the panel 8 is allowed to approach the roof trim 21 side to which the second connector 6 is mounted. With this operation, as shown in FIG. 12, the second connector 6 is inserted into the first connector 2 which is temporarily locked to the holder 1.

Figure 13:
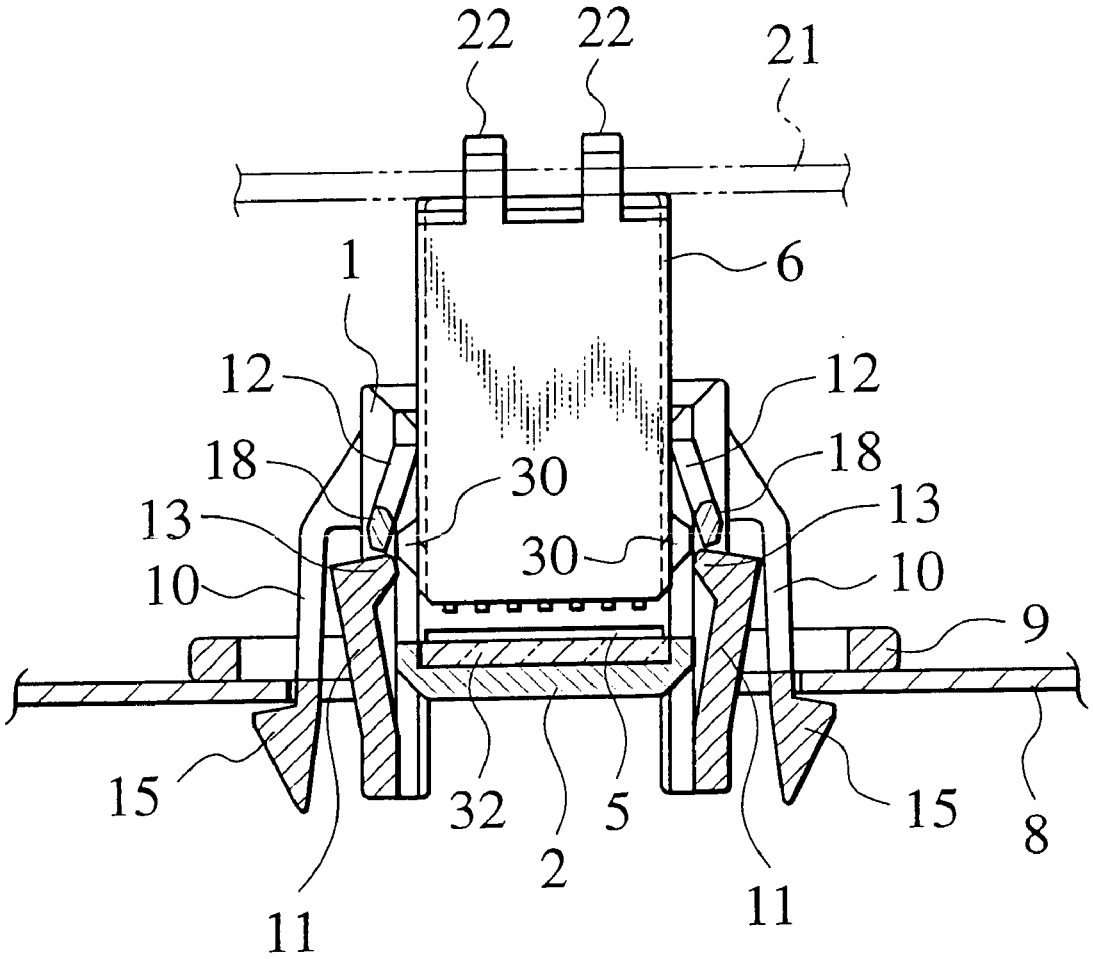
FIG. 13 is a view showing action of a state in which the second connector starts releasing a temporarily locked state of the first connector.

Then, the fitting operation between the first connector 2 and the second connector 6 proceeds and the releasing projections 30 provided on the first connector 2 abut against the support portions 18 provided on the temporarily displacing pieces 12 of the first connector 2. Then, the support portions 18 are pushed by the releasing projections 30, and the temporarily displacing pieces 12 are displaced outward as shown in FIG. 12. Further, from this state, if the second connector 6 enters into the first connector 2, the releasing projections 30 are brought into contact with the hooking pawls 13 on the temporarily locking arms 11 formed on the holder 1 as shown in FIG. 13, and the temporarily locking arms 11 are displaced such as to be pushed outward similarly.

Figure 14:
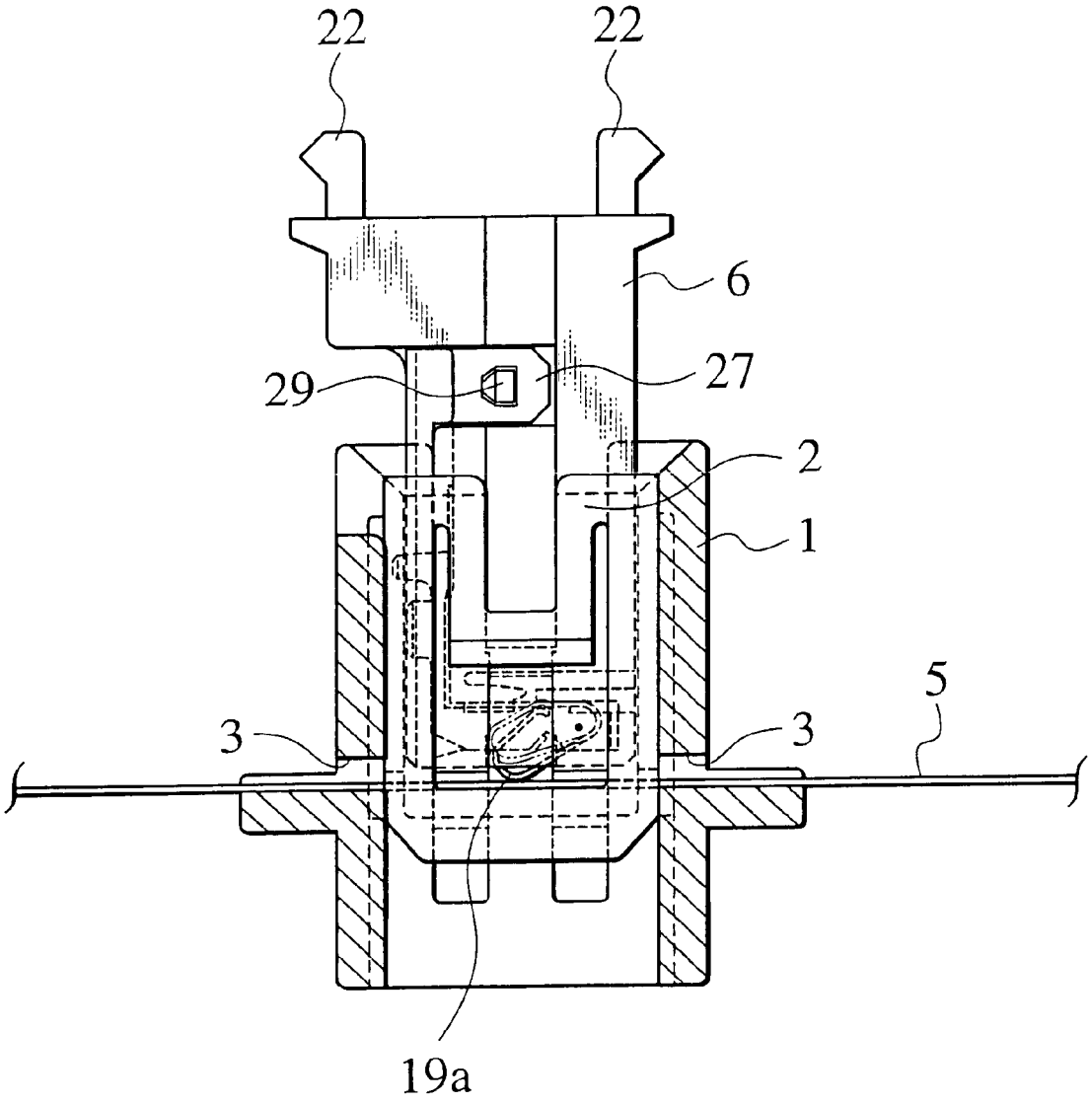
FIG. 14 is a view showing action of a state in which the temporarily locked state of the first connector is released, and the terminal metal fitting starts contacting with a wire conductor pattern of the band-like conductor.
Figure 15:
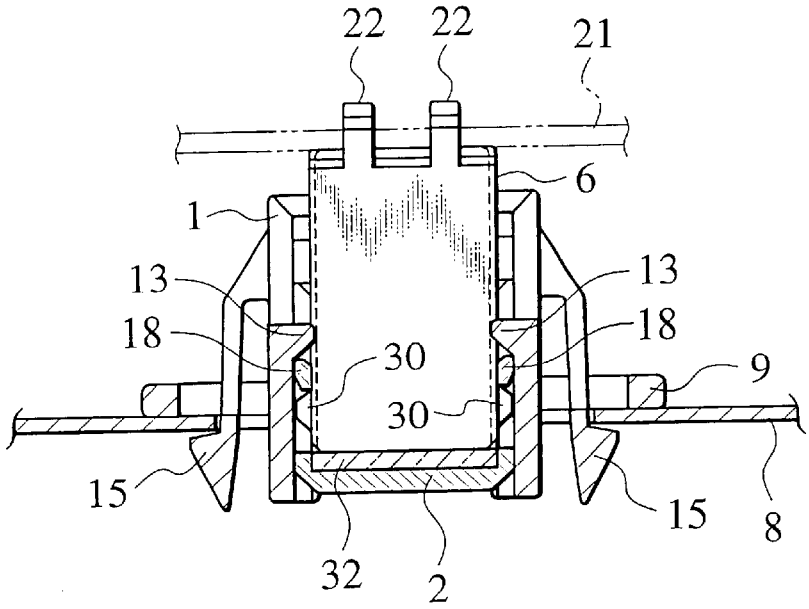
FIG. 15 is a view showing action of a halfway state in which the second connector pushes the first connector into a bottom of the holder.

While the releasing projections 30 push the temporarily locking arms 11 outward, the contact between the releasing projections 30 and the support portions 18 is released, and the temporarily displacing pieces 12 are returned to their original states. Substantially simultaneously, the contact portion 19*a* provided on the second connector 6 cones into contact with the wire conductor pattern of the band-like conductor 5 as shown in FIG. 14. Then, the releasing projections 30 abut against the hooking pawls 13 to displace the temporarily locking arms 11 outward. During this time, as shown in FIG. 15, the second connector 6 pushes the first connector 2 into the bottom of the holder 1. At that time, since the band-like conductor 5 is sandwiched between the receiving stage 32 disposed on the bottom of the first connector 2 and the contact portion 19*a* provided on a tip end of the second connector 6, slip is generated between the band-like conductor 5 and the contact portion 19*a* and the receiving stage 32.

With this slip, a surface of the exposed wire conductor pattern on which the insulative film is not provided is scrubbed by the contact portion 19*a*. As a result, the insulative matter such as oxide film adhered on the surface of the wire conductor pattern is removed, and the contact between the wire conductor pattern and the terminal metal fitting 19 is ensured.

Figure 16:
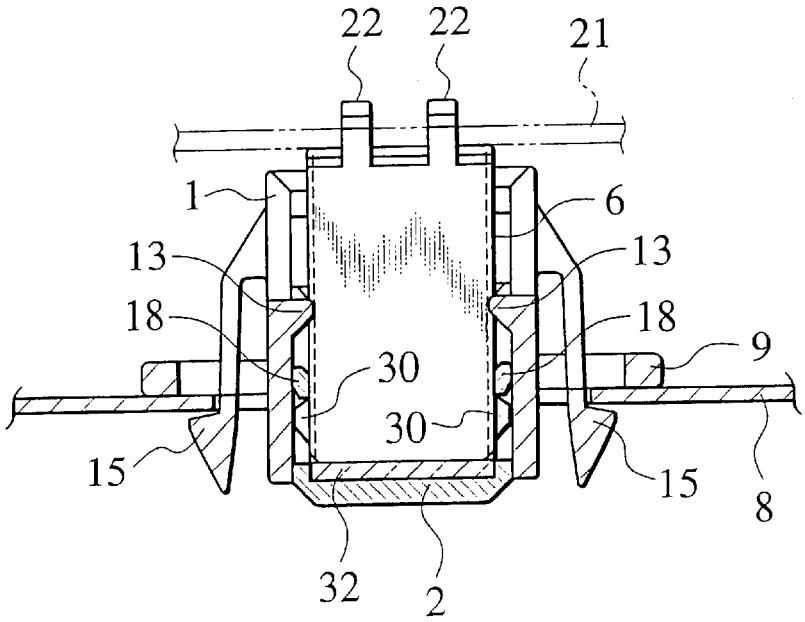
FIG. 16 is a view showing action of a state in which the fitting operation between the first connector and the second connector is completed.
Figure 17:
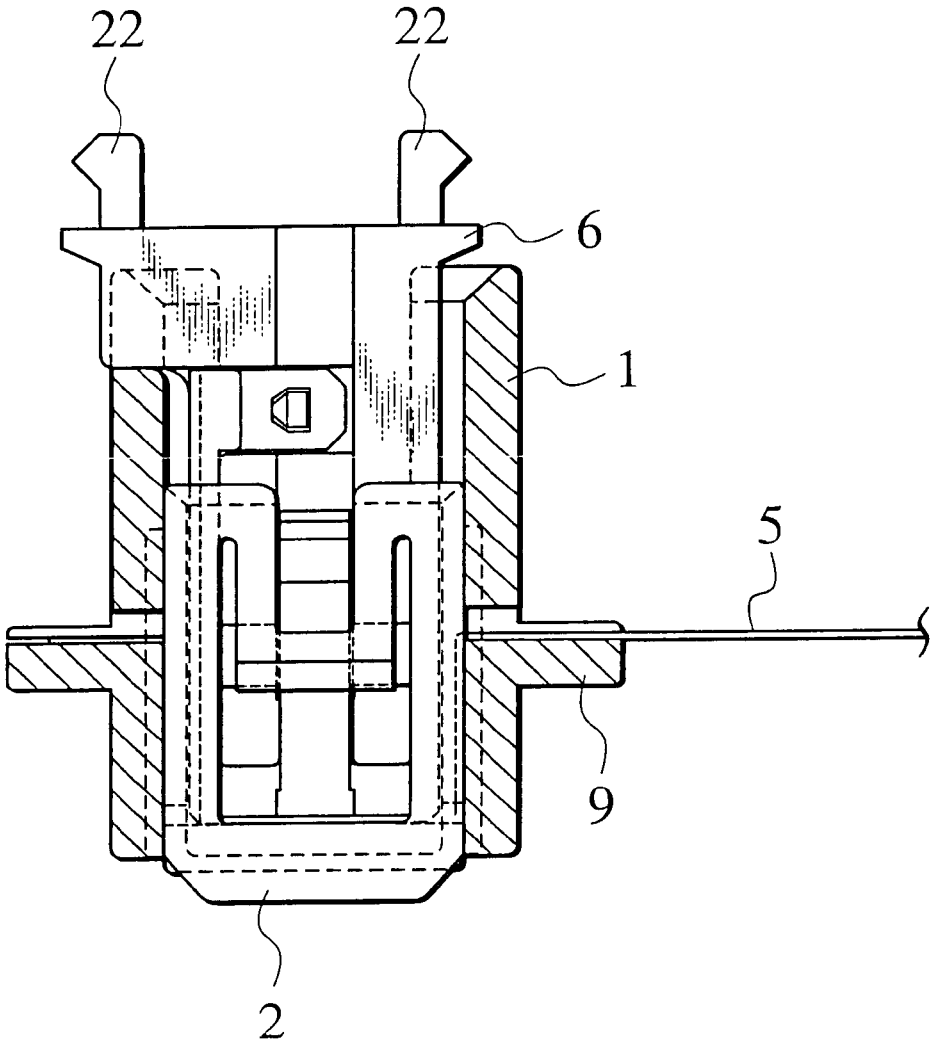
FIG. 17 is a view showing action of a state in which the fitting operation between the first connector and the second connector is completed, and shows an arrangement state of the band-like conductor.

When the second connector 6 pushes the first connector 2 toward the bottom of the holder 1, the band-like conductor 5 sandwiched between the first connector 2 and the second connector 6 is pulled toward the bottom of the holder 1. FIGS. 16 and 17 show that the second connector 6 is finally coupled to the first connector 2. In this final state, since the wire conductor pattern of the band-like conductor 5 from which the insulative matter is removed is brought into contact with the receiving stage 32 disposed on the bottom of the second connector 6 and the terminal metal fitting 19 of the second connector 6 under pressure, electrical connection is reliably established. A terminal of the band-like conductor 5 is pulled toward the bottom of the holder 1 by a distance corresponding to movement of the first connector 2 in its fitting direction and therefore, this prevents excessive length of the band-like conductor 5.

As described above, although the concrete embodiment to which the present invention is applied has been explained, the invention is not limited to the embodiment and various modifications can be made.

For example, in the embodiment as described above, although the connector for the sun visor for the automobile and the connector provided in the roof trim are connected to each other utilizing the band-like conductor, the invention is not limited to this, and the invention can be applied to any fields other than the connector for the sun visor.

What is claimed is:

1. A band-like conductor connecting connector comprising:

a holder;

a first connector which is accommodated and temporarily locked in the holder;

a band-like conductor disposed substantially straightly from one side surface to the other side surface of the holder through openings and respectively formed in the holder and the first connector such as to pass therethrough, the band-like conductor sandwiching a plurality of wire conductor patterns with an insulative film and a portion of the band-like conductor at least disposed in the holder exposing the wire conductor patterns; and a second connector which is inserted into the first connector to release a temporarily locked state between the first connector and the holder, and which pushes the band-like conductor together with the first connector toward a bottom of the holder, wherein in a process during which the second connector pushes the first connector toward the bottom of the holder, a plurality of terminal metal fittings provided on a tip end of the second connector push the band-like conductor into the bottom of the holder while scrubbing the exposed wire conductor patterns.

2. A band-like conductor connecting connector according to claim 1, wherein the band-like conductor is sandwiched between the bottom of the first connector and the second connector.

3. A band-like conductor connecting connector according to claim 1, wherein the second connector comprises:

a terminal metal fitting which comes into contact with the exposed band-like conductor:

a connector body holding an electric wire connected to the terminal metal fitting;

an electric wire holding groove provided in the connector body, an electric wire cover covering the electric wire held in the electric wire holding groove; and a hinge connecting the electric wire cover and the connector body, wherein the electric wire cover can turn around the hinge.

4. A band-like conductor connecting connector according to claim 3, wherein the terminal metal fitting includes a contact portion which comes into contact with the wire conductor patterns, a portion of the contact portion projecting from an end surface of the second connector in a direction in which the second connector is fitted to the first connector is curled, thereby providing the contact portion with resiliency, the contact portion is brought into contact with the wire conductor patterns under pressure with this resiliency.

5. A band-like conductor connecting connector according to claim 4, wherein the end Surface of the second connector in the direction in which the second connector is fitted to the first connector has a contact portion accommodating groove in which the contact portion is accommodated.

6. A band-like conductor connecting connector according to claim 3, wherein the second connector is provided on its surface opposite from a direction in which the second connector is fitted to the first connector with at least one fixing connector mounting portion for fixing the second connector to a roof trim.

7. A band-like conductor connecting connector according to claim 3, wherein the second connector has a pair of releasing projections which are projected from opposite side surfaces of the second connector on the side in which the second connector is fitted to the first connector of the connector body, the releasing projections release the temporarily locked state between the first connector and the holder.

8. A band-like conductor connecting connector according to claim 1, wherein the holder comprises:

a housing body accommodating and holding the first connector;

a flange portion mounting and fixing the housing body to a panel;

a temporarily locking arm temporarily locking the first connector; and a hooking arm portion, wherein the hooking arm portion fixes the holder on the panel, a hooking pawl provided on a tip end of the temporarily locking arm temporarily locks the first connector and the holder.

9. A band-like conductor connecting connector according to claim 8, wherein the flange has a substantially rectangular plane, the flange is disposed such as to cover an opening peripheral portion of a holder mounting hole formed in the panel.

10. A band-like conductor connecting connector according to claim 8, wherein the hooking arm portion is formed on a side wall of the housing body formed with the temporarily locking arm, and is formed into a cantilever shape extending from a base end in such a manner that an insertion side of the first connector serve as the base end and a tip end side of the first connector serves as a free end, and further, a tip end of the arm constitutes a grasping pawl, the grasping pawl and the flange portion sandwich and fix the panel.

11. A band-like conductor connecting connector according to claim 8, wherein the holder is provided at portions of opposed side walls and the flange which are adjacent to a side wall provided with the hooking arm portion with an opening portion having such a size that the band-like conductor can be inserted therethrough.

12. A band-like conductor connecting connector according to claim 1, wherein the first connector is a box having an inner space into which the second connector can be fitted and having a size capable of being accommodated in the holder, the first connector has a temporarily displacing piece which is temporarily locked to the holder, the temporarily displacing piece is formed into a substantially U-shape through connection portions at opposite edges in a longitudinal direction of the first connector, the temporarily displacing piece abuts against the hooking pawl of the temporarily arm and becomes a support portion, the temporarily displacing piece can be displaced outward in such a manner that the support portion serves as a free end.

13. A band-like conductor connecting connector according to claim 12, wherein the first connector is provided at its bottom with a receiving stage of the band-like conductor.

14. A band-like conductor connecting connector according to claim 12, wherein the first connector has opposited opposite side walls which are adjacent to a side wall provided with the temporarily displacing piece, the opposite side walls are provided with opening portion having such a size that the band-like conductor can be inserted therethrough.

* * * * *

UNITED STATES PATENT AND TRADEMARK OFFICE

CERTIFICATE OF CORRECTION

PATENT NO. : 6,609,916 B2
DATED : August 26, 2003
INVENTOR(S) : Toshiaki Okabe

It is certified that error appears in the above-identified patent and that said Letters Patent is hereby corrected as shown below:

Title page,
Below Item [65], Prior Publication Data, insert the following:

-- [30] Foreign Application Priority Data

Aug. 10, 2000 (JP) . . . . . 2000-242860 --.

Column 7,
Line 67, "conductor:" should read -- conductor; --.

Column 8,
Line 22, "end Surface" should read -- end surface --.

Signed and Sealed this

Ninth Day of March, 2004

JON W. DUDAS
*Acting Director of the United States Patent and Trademark Office*